US007356984B2

(12) United States Patent
Brenk

(10) Patent No.: US 7,356,984 B2
(45) Date of Patent: Apr. 15, 2008

(54) DEVICE AND METHOD FOR TREATMENT OF A TRAVELING YARN WITH A STEAM-CREATING TREATMENT MEDIUM

(75) Inventor: Siegfried Brenk, Krefeld (DE)

(73) Assignee: Saurer GmbH & Co. KG (DE)

( * ) Notice: Subject to any disclaimer, the term of this patent is extended or adjusted under 35 U.S.C. 154(b) by 573 days.

(21) Appl. No.: 10/966,498

(22) Filed: Oct. 15, 2004

(65) Prior Publication Data

US 2005/0081335 A1 Apr. 21, 2005

(30) Foreign Application Priority Data

Oct. 17, 2003 (DE) ..... 103 48 277

(51) Int. Cl.
*D01H 13/30* (2006.01)

(52) U.S. Cl. ..... 57/295; 57/308; 57/309

(58) Field of Classification Search ..... 57/295, 57/308, 309, 350; 28/247, 271; 8/149.3
See application file for complete search history.

(56) References Cited

U.S. PATENT DOCUMENTS 2,398,856 A * 4/1946 Reel ..... 68/6
3,724,088 A * 4/1973 Lefebvre et al. ..... 34/452
3,742,695 A * 7/1973 Conrad ..... 57/289
3,783,596 A * 1/1974 Waldkirch ..... 57/296
3,837,186 A * 9/1974 Lefebvre et al. ..... 68/3 SS
3,921,419 A * 11/1975 Rosenkranz et al. ..... 68/5 D
3,940,955 A * 3/1976 Welsh ..... 68/20
4,064,684 A * 12/1977 Nijhuis ..... 57/296
4,148,179 A * 4/1979 Becker et al. ..... 57/350
4,768,336 A * 9/1988 Stahlecker et al. ..... 57/328
6,168,743 B1 * 1/2001 Reese et al. ..... 264/345
6,513,315 B1 * 2/2003 Alavoine et al. ..... 57/286

* cited by examiner

*Primary Examiner*—Shaun R. Hurley
(74) *Attorney, Agent, or Firm*—Robert W. Becker; Robert W. Becker & Assoc.

(57) ABSTRACT

A device for treatment of a traveling yarn with a steam-creating medium includes a column of several chambers provided with yarn inlet- and yarn outlet-channels and arranged one over the other, of which one of the chambers is a steam treatment chamber provided with a steam inlet and a condensate outlet with respect to which mixing chambers are respectively operated upstream and downstream thereof, with each such mixing chamber respectively having an air inlet and a condensate outlet. The yarn inlet- and yarn outlet-channels have an opening cross section that, on the one hand, makes possible a pneumatic yarn threading-in and, on the other hand, controls the exchange of air and steam between the chambers such that a steam-air-mixture atmosphere sets in that substantially forecloses the entrance of air into the steam treatment chamber.

24 Claims, 2 Drawing Sheets

DEVICE AND METHOD FOR TREATMENT OF A TRAVELING YARN WITH A STEAM-CREATING TREATMENT MEDIUM

BACKGROUND OF THE INVENTION

The invention relates to a device for treating a traveling yarn with a steam-creating treatment medium that is under pressure. This device can, in particular, serve as a thermal fixation device by which the traveling yarn is heated in a steam handling zone and is subsequently dried and cooled in a cooling-and drying zone in a manner such that the yarn maintains the condition that it has reached in the steam handling zone.

The term "steam" is used representatively for, as well, other gaseous media.

SUMMARY OF THE INVENTION

The goal of the invention is thus the optimization and conservation of the physical effects that have been achieved in the steam handling zone, via cooling and drying the treated yarn with simultaneous least-possible energy inputs in the steam handling zone and in the cooling-and drying zone.

The overall configuration of the device including its functional operation is described in more detail hereinafter with reference to the drawings.

DESCRIPTION OF THE SPECIFIC EMBODIMENTS

The inventive device is comprised of several chambers that are, in particular, vertically arranged one over another, and are capable of being impacted with steam or, respectively, pressurized air, whereby neighboring chambers are respectively connected with one another by means of yarn inlet and yarn outlet channels centrally arranged over one another, the opening cross-sections of such channels being so configured that, on the one hand, a pneumatic yarn threading-in via the yarn inlet and the yarn outlet channels of the entirety of the chambers is possible while, on the other hand, a penetration of air into the chamber capable of being impacted with steam should be substantially foreclosed.

Figure 1:
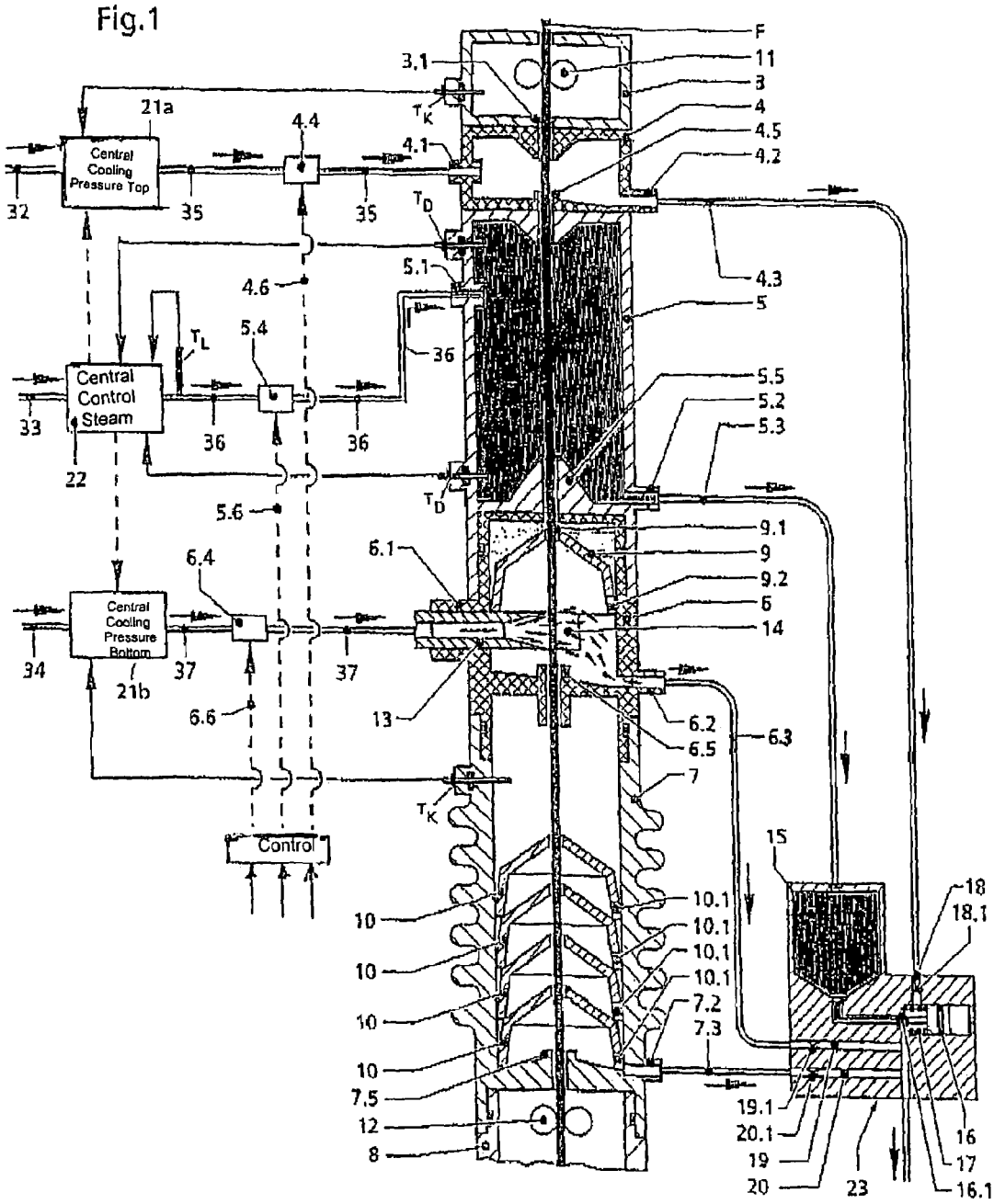
FIG. 1 is an axial sectional view of the device with a condensate drainage apparatus connected thereto.
Figure 2:
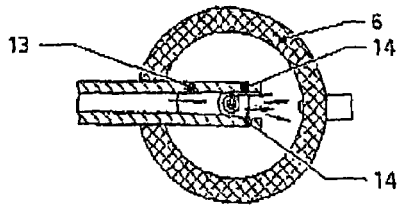
FIG. 2 is a horizontal sectional view of the device in the region of the mixing-and-cooling zone.

The device includes an upper pre-chamber 3 in which a yarn delivery roller 11 for the yarn F is disposed. A mixing chamber 4, which is preferably formed of a heat insulating, in particular a ceramic, material, follows the pre-chamber 3, the mixing chamber 4 comprising an air inlet 4.1 and a condensate outlet 4.2. A steam treatment chamber 5 follows the mixing chamber 4, the steam treatment chamber having a steam inlet 5.1 as well as a condensate outlet 5.2 that can be closed. A mixing/cooling chamber 6 that is preferably formed of ceramic material follows the steam treatment or handling chamber 5, the mixing/cooling chamber having an air inlet 6.1 for the cooling air that is under pressure as well as a condensate outlet 6.2. A jet 13 ending in the vicinity of the yarn travel path is extended through the air inlet 6.1, protection plates 14 being connected to the jet that are, as seen in FIG. 2, preferably disposed laterally of the yarn travel path. A cooling and drying chamber 7 follows the mixing chamber 6, into which flows, through the yarn channels that connect the two chambers 6 and 7, cooling air, and the cooling and drying chamber comprises a condensate outlet 7.2. An end chamber 8 follows the cooling and drying chamber 7 in which a second yarn delivery roller 12 is disposed.

In order to foreclose an inflow of condensate into the respective chamber that is disposed therebelow, upwardly projecting reverse walls 4.5, 5.5, 6.5, or, respectively, 7.5, are arranged in the region of the floor or, respectively, the yarn outlet channels of the chambers 4, 5, 6, and 7. The floor of the upper pre-chamber 3 is, in contrast, provided with an indentation 3.1 that encircles the yarn outlet channel, in order to permit the flowing out of the condensate that may have, under certain conditions, built up in the pre-chamber.

The pair of yarn delivery rollers 11 and 12 serve the purpose of maintaining the yarn in a tension-free condition, or with the least possible yarn tension, as the yarn travels through the device.

Figure 3:
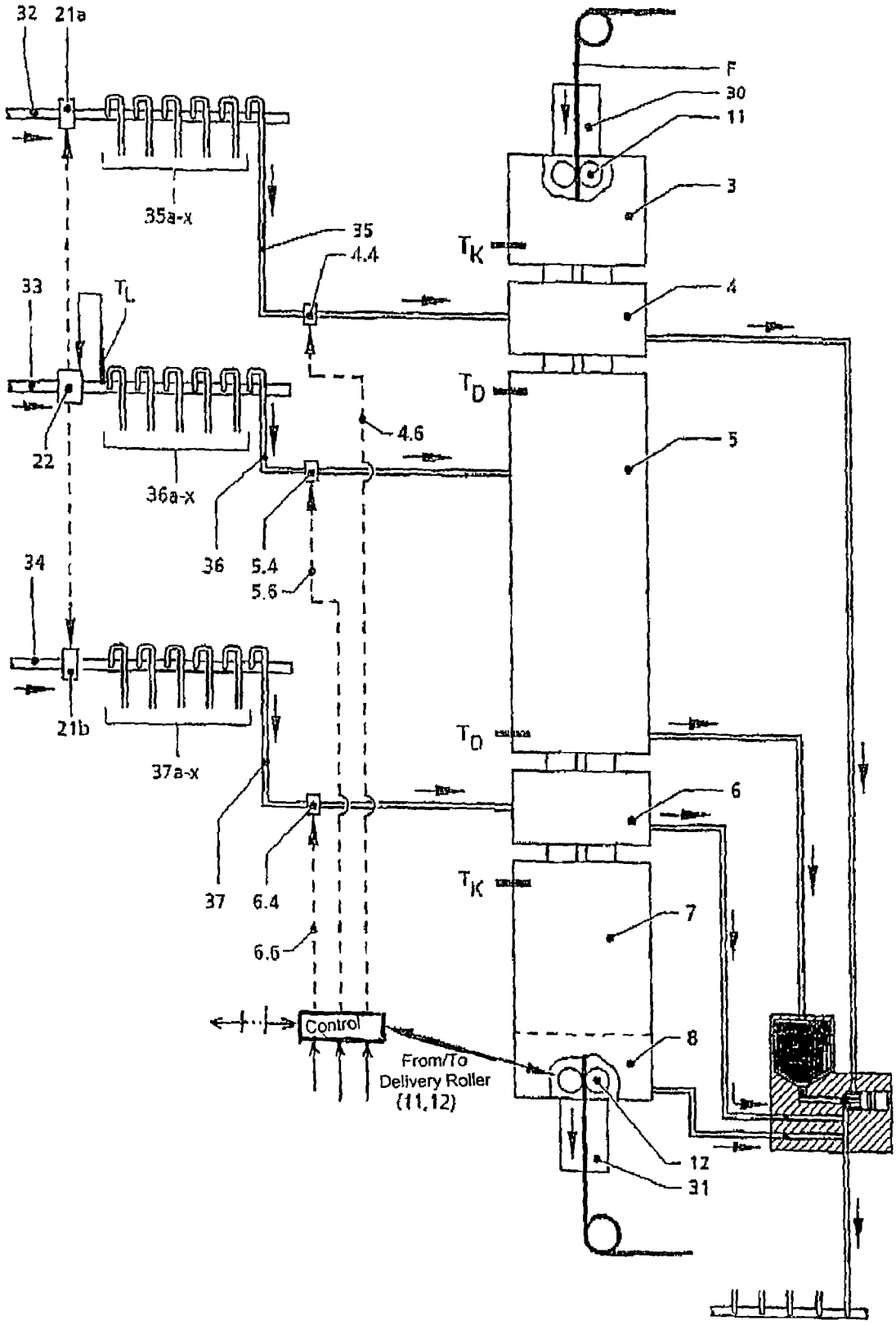
FIG. 3 is a schematic elevational view of the connection of a yarn treatment extent on the control and regulation system of a multi-position machine.

A schematically illustrated yarn sluice 30 is, in accordance with FIG. 3, upstream of the pre-chamber 3 and a yarn sluice 31 follows the lower end chamber 8, in any event. These yarn sluices 30, 31 are arranged, in a manner not comprised within the present invention, of elongate yarn guide elements that bound a yarn channel, the yarn channel being filled by the yarn traveling therethrough such that the yarn itself serves as the sealing element in order to foreclose an exit of the treatment media out of the device.

The pre-chamber 3 and the cooling and drying chamber 7 are outfitted with temperature sensors $T_K$ that are connected to regulating valves 21*a* or, respectively, 21*b*, these regulating valves controlling the introduction of air into the chambers 4 and 6 via the valves 4.4 or 6.4 provided, respectively, upstream of these chambers.

The yarn treatment chamber 5 is outfitted with temperature sensors $T_D$ that control, via a regulating valve 22, the introduction of steam into the steam treatment chamber 5. The pair of regulating valves 21*a*, 21*b* are coupled with the regulating valve 22 in order to commonly regulate or, respectively, control, the respective pressure values and, consequently, the temperature values, in the individual chambers.

A preferably bell-shaped floor 9 is disposed in the mixing/cooling chamber 6 above the jet 8 and is arched upwardly to reach the chamber inner wall, the floor 9 comprising a centrally arranged yarn opening 9.1 and at least one condensate outflow opening 9.2 in the region of its edge lying below and bordering on the chamber inner wall. In this chamber 6, the mixing zone is substantially above the floor 9 while the cooling zone lies underneath this floor. The bell-shaped floor leads to a closing off of the cooling zone that is located underneath this floor relative to a steam inlet, as the steam particles entrained by the yarn are stripped out from this floor by means of the yarn. A steam condensation occurs above this floor 9 and the condensate that is formed as a consequence thereof flows through the condensate outflow opening 9.2 on the inner wall region of the chamber 6 to the condensate outlet 6.2.

The cooling and drying chamber 7 comprises at least one preferably bell-shaped floor 10 that is arched upwardly to reach the chamber inner wall, the floor having a centrally arranged yarn opening and at least one condensate outflow opening 10.1 in the region of its lower edge bordering on the inner wall of the cooling- and drying-chamber 7. Preferably, four such bell-shaped floors 10 are provided.

The condensate outlet 5.2 of the steam treatment chamber 5 is connected via a condensate conduit 5.3 to a condensate container 15 whose outlet can be closed by a controllable valve 16, the valve body 16.1 of which can be adjusted against the force of a spring 17.

The condensate outlets 4.2 or, respectively, 6.2 or, respectively, 7.2, of the chambers 4 and 6 as well as the cooling and drying chamber 7 are connected via conduits 4.3, 6.3, or respectively, 7.3 to the outflow channels 18, 19, or, respectively, 20 of the condensate outlet device 23 that comprises respective restrictors 18.1, 19.1, or, respectively, 20.1.

The upper mixing chamber .4 into which pressurized air is introduced via the air inlet 4.1 serves to close off the steam treatment chamber 5 in order to prevent the penetration of air into the steam treatment chamber 5 in that, in this mixing chamber 4 via suitable control of the air flowing into this chamber 4, a steam/air/mixture atmosphere sets in.

The mixing/cooling chamber 6, which follows the steam treatment chamber 5, serves as well as the upper mixing chamber 4 for closing off the steam treatment chamber 5 against the penetration of air from below thereinto. Due to the reason that, in this chamber 6, the cooling air is guided in the greatest possible thickness onto the yarn via the jet/protection plate system 13/14, there follows a rapid cooling off of the yarn that has heretofore been treated with steam in order to effect the highest possible thermal fixation effect. At the same time, within this chamber 6, the water vapor or steam that has been entrained by the yarn should be driven out—that is, the yarn should already, to a certain extent, be pre-dried. The bell-shaped 9 located above the system 13, 14 leads, as well, via a "stripping out" of steam to a clearance of the steam.

Via the use of ceramic material, the pair of chambers 4 or, respectively, 6, are substantially protected from being heated up from the neighboring steam treatment chamber so that, in the region of these chambers 4 or, respectively, 6, only a relatively low heat energy loss occurs. The yarn pass through channel between the steam chamber 5 and the thereafter following chamber 6 is configured relatively long, whereby a mechanical closing off of the steam treatment chamber 5 is effected.

The cooling air introduced via the jet 13 is conducted directly transverse to the traveling yarn in the mixing chamber 6, whereby the advantage arises that, as the cooling air introduction is thermally de-coupled, this cooling air has influence directly on the yarn traveling therepast which leads to reduced air streams and thereby to the greatest possible cooling effect. Via the introduced cooling air, the remainder steam particles between the yarn fiber capillaries of the yarn are substantially driven out of the yarn so that the yarn is dried. The cooling air stream must be so adjusted via suitable choice of the jet outlet that a twirling travel of the yarn is avoided.

The thereafter following cooling and drying chamber 7, in which the cooling air from the mixture chamber 6 enters via the yarn channel connecting these two chambers, effects a further cooling off and drying. The remainder steam entrained by the yarn that still exists in this cooling and drying chamber 7 is driven out via the bell-shaped, upwardly arched floor 10 in the above-described manner, whereby the remainder condensate is outletted via the condensate outlet 7.2 and via the conduit 7.3.

The cooling and drying chamber 7 is configured with ribs in a geometric configuration such that a maximum thermal radiation effect follows—that is, this cooling chamber 7 is heated in the least possible range from the remainder steam entrained with the yarn.

The condensate that occurs during the heating up cycle due to the flowing in of steam into the treatment chamber 5 is captured in the condensate container 15 and, as required, is released after the reaching of the operational temperature $T_D$ in the chamber 5 via a short term opening of the valve 16.

Important features of the performance of the method are comprised in the following listing:

- ⌘tension-free guiding of the yarn,
- ⌘exact temperature guiding,
- ⌘exact length of the yarn path through the steam- or gas-treatment zone;
- ⌘adequate and rapid cooling off of the yarn for the purpose of achieving thermal fixation thereof, before the yarn can again be mechanically loaded;
- ⌘simultaneous effect of temperature, velocity, and cooling off of all treatment extents of a multi-position machine;
- ⌘secure and cost favorable configuration of the system;
- ⌘clean running in and extraction of the individual handling extents taking into consideration the condensate diversions with a steam treatment.

The process is described as a thermal fixation process by which saturated steam with a temperature of 135° C. in the steam treatment chamber 5 is introduced via a steam conduit 36 that is communicated with a steam central conduit 33 to which, in accordance with FIG. 3, further treatment extents are connected via individual connection conduits 36*a*-36*x*.

In a comparable manner, the chambers 4 and 6 are connected to the central conduits 32 or, respectively, 34, via individual connection conduits 35 or, respectively, 37. Individual connection conduits 35*a-x* or, respectively, 37*a-x*, are connected on both central conduits 32, 34. The pressurized air conduits 35 or, respectively, 37, are provided with block valves 4.4 or, respectively, 6.4, and the steam conduit 36 comprises a block valve 5.4.

In accordance with the invention, one permits the individual yarn F to travel in a substantially tension-free manner through the various chambers of the treatment extents.

The pressurized air inflow pressure in the chambers 4 and 6 and the steam inflow pressure in the steam treatment chamber 5 are controlled as a function of the cross sections and lengths of the yarn channels that connect these chambers with one another and, as the occasion arises, with further chambers, so that a flowing in of steam into the chambers 4 and 6 occurs only in a scope such that there occurs a steam-air-mixture atmosphere in these chambers that prevents an inflow of air, whereby the condensate that is formed in these chambers 4 and 6 is continually throttled in the condensate outlet device 23.

To regulate the steam temperature and the pressurized air temperatures, the steam temperature sensor $T_D$, in the region of the steam treatment chamber 5, and the air temperature sensor $T_K$ in the pre-chamber 3 operated ahead of the upper chamber 4, are deployed. The received temperatures are used as regulation parameters for the regulating valves (central regulators) 21*a*, 22, and 21*b* connected to the central conduits 32, 33, and 34. A "control" block is connected via non-illustrated conduits to the temperature sensors $T_K$ and $T_D$ and to the yarn delivery rollers 11 and 12. During the undershooting or overshooting of predetermined temperature tolerance regions, especially in the chambers 3 and 7, the individual yarn treatment extents are shut off by means of the valves 4.4, 5.4, and 6.4 by the central conduits 32, whereby the travel of the yarn F through the device is interrupted via the shutting off of the yarn delivery rollers 11, 12. In the event of the running out of the yarn or in the event of a yarn break or in the event of the failure of a yarn delivery roller, there follows, in any event, the closure of the valves 4.4, 5.4, and 6.4 via the "control" block, these valves being connected via the control conduits 4.6, 5.6, or, respectively, 6.6. During the heating up phase, the steam treatment chamber 5 is heated up to the required treatment temperature, whereby the temperature is measured by means of the steam temperature sensor $T_D$. During the heating up phase, the chambers 4 and 6 that are operated, respectively, before and after the chamber 5, are impacted with pressurized air in a manner such that, after the buildup of a predetermined air-steam-mixture atmosphere in these chambers 4 and 6, there is substantially no possibility that any further steam can exit the chamber 5 into these chambers. In this connection, it is important that the condensate that is continually formed in these chambers 4 and 6, as well as the condensate that forms in the chamber 5, are conducted away.

The regulation of the respective air-and steam pressures is centrally effected in accordance with the following modes:

The temperature sensor $T_D$ in the chamber 5 shows that the desired treatment temperature that has been heretofore centrally inputted or set up in the regulating valve (central regulator) 22 has been reached. This temperature forms the guide parameter and must lie within a predetermined tolerance range. A comparison control follows via a temperature sensor $T_L$ in the steam conduit 36.

By means of the temperature sensor $T_K$ in the chamber 7, it is established whether, in this chamber, a temperature, the value of which is dictated by physical effects, has been created that is less than the steam temperature $T_D$. If the temperature in the chamber 7 overshoots or exceeds the temperature within a certain tolerance range, the air pressure in the chamber 7 centrally must be increased in small steps in a corresponding manner, whereby the cooling effect is reinforced and is stronger.

If the temperature $T_D$ in the treatment chamber has been clearly undershot, a technical defect will occur such as, for example, non-uniformity of the thickness, such that the individual treatment extents must be de-activated.

If the lower temperature limits of the temperature $T_K$ are undershot, the air pressure in the cooling zone is centrally lowered in a finely incremented manner so that the steam in the mixing zone receives a relatively greater weight and the cooling temperature in the chamber 7 is slightly increased.

The cooling pressure in the air conduits 35 and 37 and, consequently, in the chambers 4 and 6, must be regulated independently of one another via the respective regulators 21*a* or, respectively, 21*b*, because the steam traveling through chamber 5 entrains steam medium therewith into the chamber 6, which leads to different conditions in the chamber 6 than the conditions in chamber 4.

The specification incorporates by reference the disclosure of german priority document 103 48 277.6 filed Oct. 17, 2003.

The present invention is, of course, in no way restricted to the specific disclosure of the specification and drawings, but also encompasses any modifications within the scope of the appended claims.

The invention claimed is:

1. A device for treatment of a traveling yarn with a steam-creating medium, comprising:

a column of several chambers provided with yarn inlet- and yarn outlet-channels and arranged one over the other, of which one of the chambers is a steam treatment chamber provided with a steam inlet and a condensate outlet; and mixing chambers respectively operated upstream and downstream of the steam treatment chamber, each mixing chamber respectively having an air inlet and a condensate outlet, the yarn inlet- and yarn outlet-channels of the steam treatment chamber having an opening cross section that, on the one hand, makes possible a pneumatic yarn threading-in and, on the other hand, controls the exchange of air and steam between the chambers such that a steam-air-mixture atmosphere sets in that substantially forecloses the entrance of air into the steam treatment chamber, and the steam-air-mixture atmosphere being controlled by regulation devices that regulate the steam- and air-supply into the steam treatment chamber or, respectively, into the mixing chambers, wherein the air inlet in the mixing chamber downstream of the steam treatment chamber includes a jet terminating in the vicinity of the yarn travel path to which are connected protection plates.

2. A device according to claim 1, wherein the pair of mixing chambers are formed of a heat insulating, material.

3. A device according to claim 1, wherein the mixing chamber includes, above the jet, a floor that is arched upwardly to reach the chamber inner wall, the floor comprising a centrally arranged yarn opening and at least one condensate outflow opening in the region of its edge lying below and bordering on the chamber inner wall.

4. A device according to claim 1, wherein the mixing chamber downstream of the steam treatment chamber is connected to a cooling- and drying-chamber having a condensate outlet and a floor that is arched upwardly to reach the chamber inner wall, the floor comprising a centrally arranged yarn opening and at least one condensate outflow opening in the region of its edge lying below and bordering on the chamber inner wall.

5. A device according to claim 1, and further comprising yarn delivery rollers disposed relative to the area of the upper and lower ends of the column comprised of the several chambers.

6. A device according to claim 5, wherein a yarn delivery roller is disposed in the pre-chamber that is upstream of the upper mixing chamber and the other yarn delivery roller is disposed in an end chamber following a cooling- and drying-chamber.

7. A device according to claim 1, wherein the condensate outlet of the steam treatment chamber is closable.

8. A device according to claim 7, wherein the condensate outlet of the steam treatment chamber is connected via a condensate conduit to a condensate container whose outlet is closable via a controllable valve.

9. A device according to claim 8, wherein the valve body of the valve is adjustably settable against the force of a spring.

10. A device according to claim 4, wherein condensate outlets of the mixing and the cooling-/drying-chambers are connected via conduits on out flow channels that each respectively include a regulator.

11. A device according to claim 4, wherein the floor of the chambers comprising a condensate outlet are provided, in the area of the yarn outlet channels, with hold back weirs that envelops these yarn outlet channels.

12. A device according to claim 6, wherein the floor of the pre-chamber includes, in the area of the yarn outlet channel, an indentation that envelops this yarn outlet channel.

13. A device according to claim 1, and further comprising blocking valves in the air- and steam conduits leading to the chambers, which blocking valves are controlled via a "control" block in dependence upon the temperatures existing in the chambers.

14. A process for treatment of traveling individual yarns of a multi-position machine with steam, comprising:

traveling each individual yarn in a tension-free manner through a treatment stretch comprised of a mixing chamber that can be impacted with pressurized air, a steam treatment chamber that is connected to the mixing chamber and can be impacted with pressurized air, and a mixing/cooling chamber that is connected to the mixing chamber and can be impacted with pressurized air;

controlling the pressure of pressurized air flowing into the mixing chambers and the steam treatment chamber as a function of the cross sections and the lengths of the yarn channels connected with these chambers, and, as the occasion arises, connected with further channels, in a manner such that an in flow of steam into the mixing chamber occurs in such a range that a steam-air-mixture atmosphere is created in this mixing chamber that closes off the steam treatment chamber against the in flow of air; and continuously diverting away, in a restricted flow manner, the condensate that consequently forms in the mixing chambers.

15. A process according to claim 14, wherein traveling each individual yarn in a tension-free manner through a treatment stretch includes traveling the yarn through a steam treatment chamber of sufficient length for achieving the desired treatment goals.

16. A process according to claim 14, wherein traveling each individual yarn in a tension-free manner through a treatment stretch includes traveling the yarn through a cooling- and drying-chamber connected to the steam treatment chamber downstream thereof and continuously diverting away, in a restricted flow manner, the condensate that forms in the cooling- and drying-chamber.

17. A process according to claim 14, wherein traveling each individual yarn in a tension-free manner through a treatment stretch includes traveling the yarn through the steam treatment chamber and mixing chambers operated upstream and downstream of the steam treatment chamber while these chambers are supplied with pressurized air or, respectively, steam, via connection-individual conduits that are provided with blocking valves and that extend out from central conduits and central regulators of the multi-position machine.

18. A process according to claim 14, wherein continuously diverting away the condensate includes diverting away the condensate that builds up during the heating up phase in the steam treatment chamber as the steam treatment chamber is loaded with steam, and after the steam treatment chamber has reached its operational temperature, one blocks the condensate outlet.

19. A process according to claim 18, and further comprising measuring the operational temperature in the steam treatment chamber and the temperatures in the pre-chamber upstream of the steam treatment chamber and in the cooling chamber and relaying these temperatures to the central regulator organs for use as regulation parameters for the pressurized air- and steam.

20. A process according to claim 19, and further comprising blocking the respective yarn treatment extent in response to undershooting or overshooting the predetermined temperature limit values in the chambers provided with temperature sensors and interrupts the yarn travel through the yarn treatment extent.

21. A process according to claim 18, wherein the steam treatment chamber is loaded with saturated steam at a temperature of 135° C.

22. A device according to claim 3, wherein the floor has a bell-shaped form.

23. A device according to claim 4, wherein the floor has a bell-shaped form.

24. A device according to claim 1, wherein the protection plates are disposed laterally of the yarn travel path.

* * * * *